United States Patent [19]

Katz

[11] Patent Number: 4,927,215

[45] Date of Patent: May 22, 1990

[54] BATH CABINET MOUNTING AND FINISHING APPARATUS

[75] Inventor: Howard S. Katz, Riegelsville, Pa.

[73] Assignee: Robern, Inc., Bensalem, Pa.

[21] Appl. No.: 314,523

[22] Filed: Feb. 23, 1989

[51] Int. Cl.[5] ..... A40B 67/00

[52] U.S. Cl. ..... 312/224; 312/245

[58] Field of Search ..... 312/224, 245, 225, 227, 312/350

[56] References Cited

U.S. PATENT DOCUMENTS 3,301,622 1/1967 Dasovic et al. ..... 312/245

4,396,249 8/1983 Aisley ..... 312/227 X 4,750,794 6/1988 Vegh ..... 312/257 R X

*Primary Examiner*—Joseph Falk

*Attorney, Agent, or Firm*—Panitch Schwarze Jacobs & Nadel

[57] ABSTRACT

A surface-mounted bath cabinet is provided with side and body trim. Portions of the cabinet and its mounting brackets provide channels in which a bottom trim panel may be mounted. Side trim members, in the form of mirrors, also provide support for the trim panel. The mounting and trim components may be supplied as a unitary "kit".

2 Claims, 3 Drawing Sheets

BATH CABINET MOUNTING AND FINISHING APPARATUS

BACKGROUND OF THE INVENTION

This invention relates to bath cabinet mounting and finishing apparatus, and in particular, to an arrangement for mounting and finishing a bath cabinet of the surface mount type.

In conventional practice, bath cabinets may be surface mounted that is, secured to the surface of a wall, or recess mounted, with the body of the cabinet is recessed within the wall.

In surface mount installations, the sides and bottom of the cabinet, hidden from view in recess mounted installations, are in plain view. In such situations, it is desirable that the sides and bottom of the cabinet be masked, or hidden from view, and finished in an aesthetically pleasing manner.

The present invention allows for economy of manufacture and distribution by allowing one cabinet to serve for both recess and surface installations. Surface installations use a kit universal to all cabinets of the same height.

BRIEF DESCRIPTION OF THE INVENTION

The bath cabinet with which the present invention is used is one which employs the usual hollow body member, having respective side, top and rear walls, and an open front wall closed by a mirrored door, hingedly coupled to a frame associated with the body member.

When the cabinet is surface mounted, the frame and mirrored door stand away from the wall to which the cabinet is mounted by the depth of the body and frame, and the sides, bottom and top of the cabinet, as well as some of the hardware by which the cabinet is mounted, are exposed to view. The top of cabinet, because it is ordinarily well above eye level, is of no particular concern aesthetically, but the sides, which meet the eye directly, and the bottom, which may relatively easily be seen, are of concern.

Accordingly, it is the general object of this invention to provide, for use with a bath cabinet of the surface mount type, a simple and efficient finishing apparatus. In the preferred form of the apparatus, the sides of the cabinet are masked and finished by mirrored panels providing the appearance of extensions of the mirrored door or related to it in design. The bottom of the cabinet is finished by an unobjectionable planar panel. The mirored panels, bottom panel and associated hardware may be supplied as a "kit", for use of installation and use.

In a presently contemplated form of the invention, a bath cabinet is held to the wall by a wall-mounted lower mounting bracket, and a suitable number of upper brackets or clips. The lower mounting bracket engages a convenient shape or contour of the bottom or rear wall of the cabinet. The upper brackets or clips themselves engage a convenient shape or contour of the top or rear wall of the cabinet. Together, the lower and upper brackets attach the cabinet securely to a wall.

Associated with the mounting bracket in a presently preferred form of the invention is a channel, which faces a similar channel on the cabinet, preferably associated with its frame.

The first and second channels provide anchorage and support for respective edges of the bottom panel or board. The bottom board, in turn, provides a means for locating and in part anchoring and supporting a pair of side trim members, preferably mirrors, which mask and finish the side walls of the cabinet. Angle brackets, which may advantageously have profiles identical to that of the mounting bracket, may be mounted on the rear faces of the mirrors together with channels or other spacers. The spacers enable the mirrors to be affixed to the side walls of the cabinet and spaced from them by distances corresponding to the difference in width between the frame and the body of the cabinet. Thus arranged, the cabinet with its side trim provides the appearance of a mirrored box, with flush sides extending from the frame to the wall. The body itself is not apparent to the viewer. The angle brackets provide channels which engage the lateral edges of the bottom board, thus providing for the bottom and finished "frame" an appearance effectively and pleasingly masking the true bottom of the body member.

There is seen in the drawings a form of the invention which is present preferred (and which represents the best mode contemplated for carrying the inventing into effect), but it should be understood that the invention is not limited to the precise arrangements and instrumentalities shown or described.

DESCRIPTION OF PREFERRED EMBODIMENT

Figure 1:
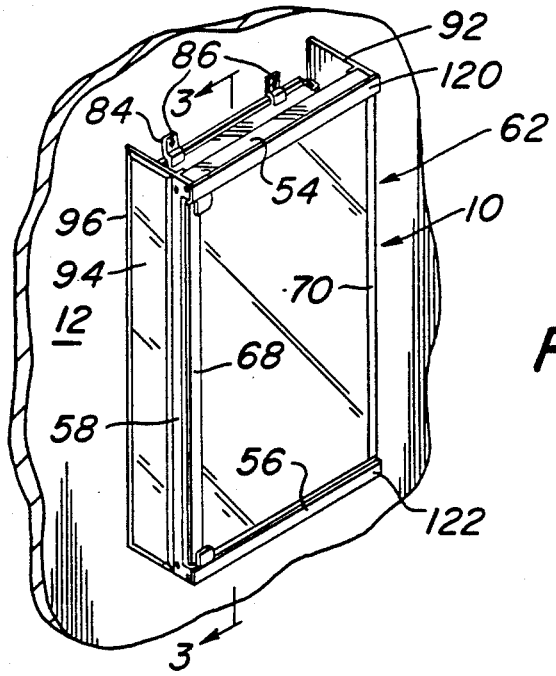
FIG. 1 is a perspective view, taken from a vantage point slightly above the cabinet, depicting a surface mounted cabinet utilizing the present invention.

Referring now to the drawings in detail, wherein like reference numerals indicate like elements, there is seen in FIG. 1 a bath cabinet designated generally by the reference numeral 10, surface mounted on a wall 12.

Figure 2:
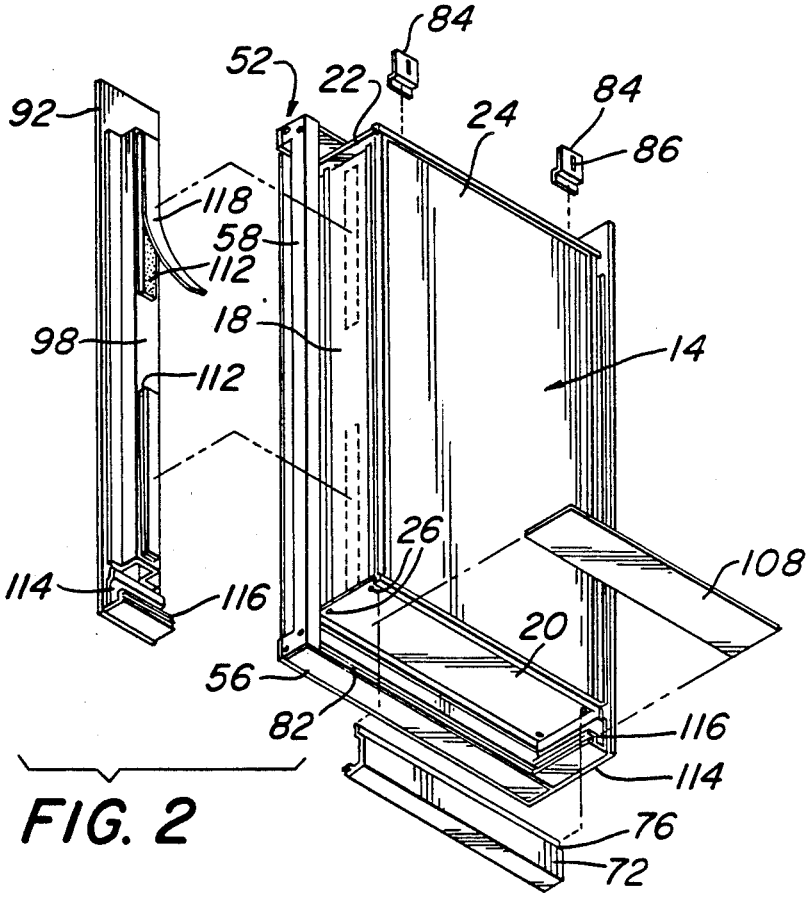
FIG. 2 is a perspective view from a lower vantage point, partly exploded to reveal details of the present invention.

Referring to FIG. 2, the cabinet 10 comprises a hollow body member, designated generally by the reference numeral 14, which includes respective side wall members 16, 18 (the latter not seen in FIG. 2), a bottom wall member 20, a top wall member 22, and a rear wall panel 24. In the illustrated form of the body member 14, the respective side wall members 16, 18, bottom wall member 20, and top wall member 22 are extruded or cast shapes, the side wall members 16, 18 and bottom and top wall members 20 and 22, respectively, being generally similar. Other constructions can be used consistently with the principles of the invention.

Figure 3:
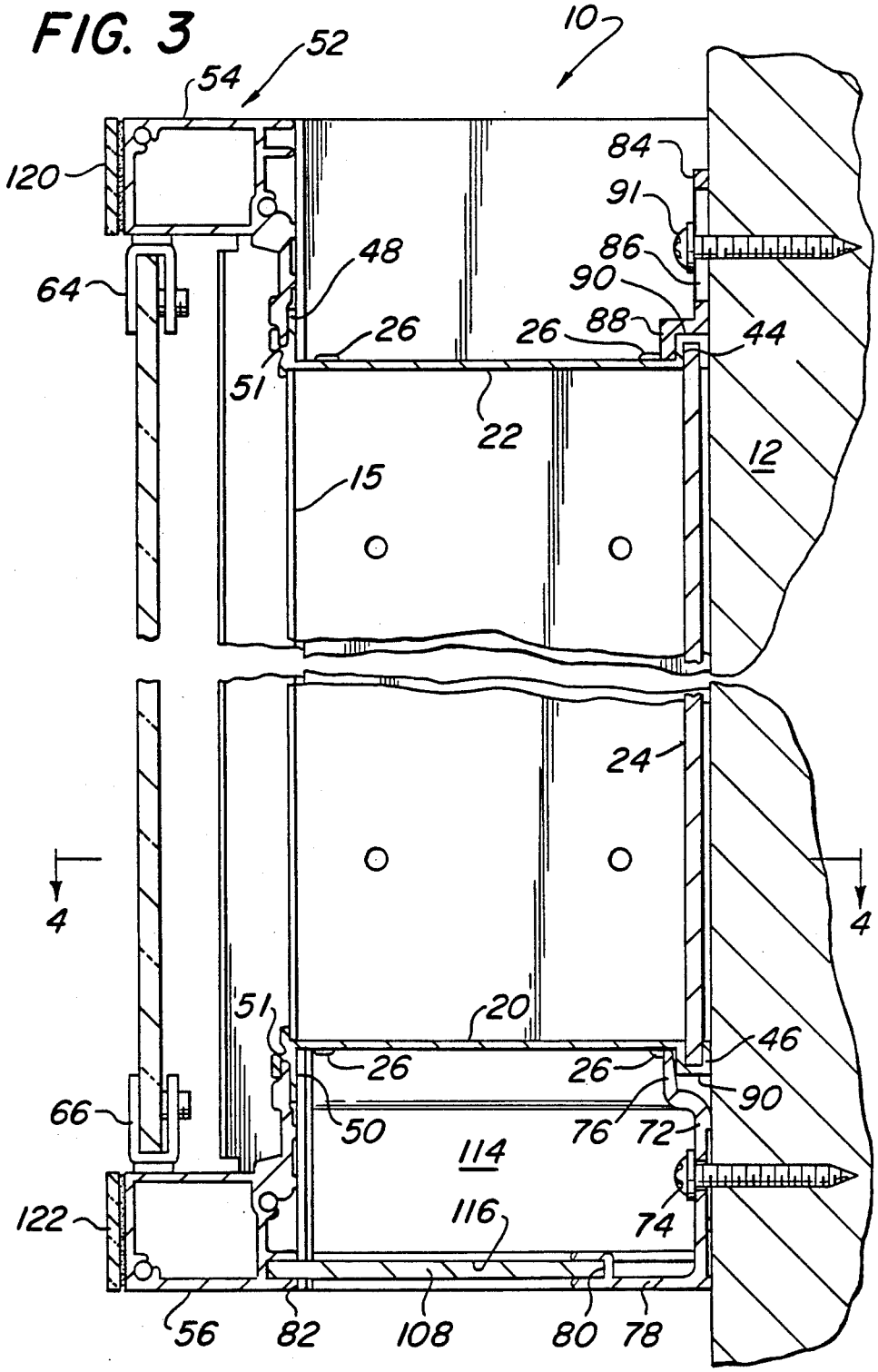
FIG. 3 is a vertical cross-sectional view, taken along the line 3—3 in FIG. 3.
Figure 4:
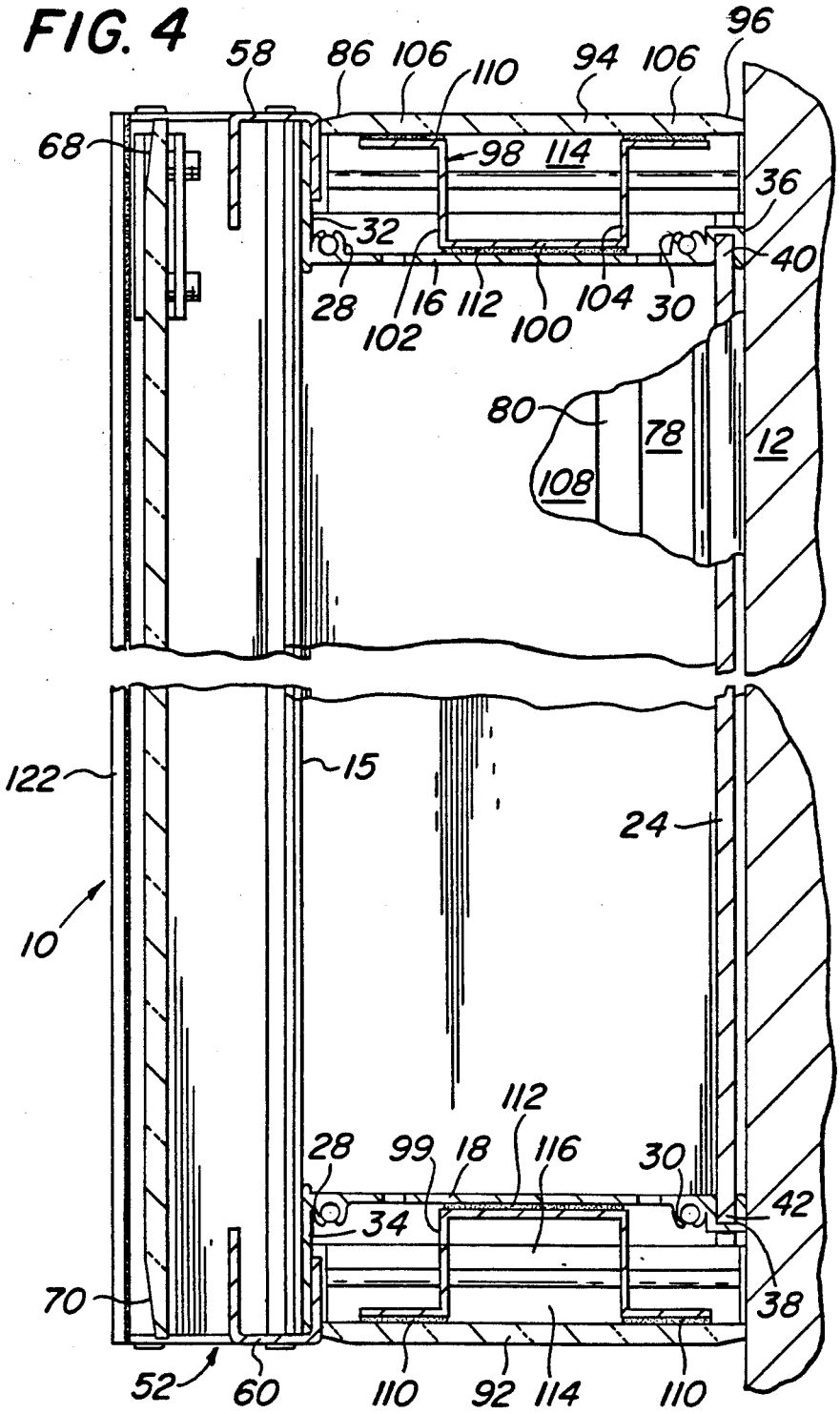
FIG. 4 is a horizontal cross-sectional view, partly broken away, taken along the line 3—3 in FIG. 1.

As is perhaps, best seen in FIG. 2 and the cross-sectional view of FIG. 4, the respective walls can be assembled by means of screws 26 (seen in FIGS. 2 and 3), which pass through pre-drilled holes in the bottom and top wall members into part circular channels 28 and 30 in the side wall members 16, 18 adapted to receive them.

Referring again to FIG. 4, the side wall members 16 and 18 are also provided with vertically oriented flanges 32 and 34, projecting laterally in a plane parallel to the plane of the opening of the body member 14, and respective open-mouthed channels 36 and 38, oriented to engage respective vertical edges 40 and 42 of the rear wall 24.

Referring now to FIG. 3, the bottom wall member 20 and top wall member 22 are likewise formed with channels, designated by the reference numerals 44 and 46, engageable with edges of the panel forming the rear wall 24. The bottom wall and top wall members 20, 22 are also provided with vertically oriented fascia panels 48 and 50.

Associated with the body member 14 and coupled to the flanges 32, 34 and fascia panels 48, 50 is a frame designated generally by the reference numeral 52. The frame 52 includes at least upper 54 and lower 56 horizontal members, interconnected by vertical frame members 58 and 60. The frame members may consisted of extruded or cast shapes, of "custom" or conventional configuration as desired.

A door in the form of a planar mirror 62, is hingedly connected to the frame 52 in juxtaposition to the open front wall of the body member 14. The mirror door 62 may be mounted, for example, to the upper frame member 54 and lower frame member 56 by respective hinges 64 and 66, best seen in FIGS. 1 and 3. The mirror door 62 may be a conventional construction and may itself be either framed or unframed and self-supporting. Its edges may be suitably beveled as seen in FIGS. 1 and 4, at 68, 70 or not, as desired.

The manner in which the bath cabinet 10 is affixed to the wall 12 is perhaps best seen by reference to FIGS. 2 and 3.

In this regard, a mounting bracket 72 is secured to the wall 12, using a suitable number of screws 74 or anchors (not shown). It will occur to those skilled in the art that, in general, conventional screws may be used where studs are available. Where studs are not available, the mounting bracket may be affixed to the wall 12 by means of conventional anchors.

The mounting bracket 72, it will be seen, includes in the illustrated embodiment a generally upwardly extending flange 76 and a generally horizontal flange 78. The distal extremity of the flange 78 defines a channel 80 which is spaced from and juxtaposed to a somewhat similar channel 82 formed in the lower frame member 56, for a purpose to be explained below. The flange 76, it will be seen, is offset from the body of the mounting bracket 72 by a distance corresponding to the external dimension of the ridge defined by the rear of the channel 46. Engagement of that ridge and the flange 76 secures the bottom of the body member 14 to the wall 12.

The top of the body member 14 may be secured to the wall 12 in the illustrated embodiment by brackets or clips 84, one of which is seen in cross-section in FIG. 3. The brackets 84 may be provided with elongated slots 86 to facilitate positioning. The brackets 84, like the above-described mounting bracket 72, include an offset flange, designated by the reference numeral 88, which, when the bracket 84 is secured to the wall 12, engages the ridge 90 defined by the rear of the channel 44 of the top wall member 22. As in the case of the screws 74 associated with the mounting bracket 72, screws 91 may be driven into studs or if studs are not available, secured by anchors.

Referring now to FIGS. 2 and 4, side finishing members, in the form of side mirrors 92 and 94, will now be described.

Referring first to FIG. 1, the side mirror 94, shown in the illustrated embodiment with bevelled edges 96, is of a width corresponding to the spacing between the vertical member 58 (and 60 as the case may be) of the frame 52 and the wall 12 when the bath cabinet 10 is surface mounted. The side mirror 94 is also preferably spaced from the side wall member 16 by a distance corresponding to the distance between the face of the side wall member 16 and the lateral edge of the vertical frame member 58. Referring to FIGS. 2 and 4, this spacing is achieved by providing, on a back face of the side mirror 94, a longitudinally extending channel member 98. The channel member 98 has, in cross-section, a rear web 100 extending parallel to the plane of the side mirror, a pair of webs 102, 104 extending generally perpendicularly with respect to rear web 100, and a pair of flanges 106 extending perpendicularly with respect to the webs 102 and 104 and parallel to the plane of the mirror 94. The channel member 98 is affixed to the rear face of the side mirror 94, conveniently by means of two-faced pressure-sensitive tape 110, although other means might be used. The rear web 100 may be affixed by similar means 112, to the side wall member 16. It will be understood, of course, that the other side mirror 92 may be similarly configured, and similarly coupled to the side wall member 18.

Referring now to FIG. 2, it will be seen that affixed to a lower portion of the side mirrors 92 and 94 is a shape 114, which may in fact advantageously be a short length of an extrusion or casting from which the mounting bracket 72 is made. The shape 114 provides, in juxtaposition to the channel 80 associated with the mounting bracket 72 (as is perhaps best seen in FIG. 3), an open-mouthed channel 116.

Referring again to FIG. 2, it will be seen that the channel 80 provided by the mounting bracket 72, the channel 82 formed in the lower frame ember 56 and the channels 116 associated with the shapes 114 affixed to the side mirrors 92 and 94 provide, in the effect, a slot which receives and securely retains, when all the members are in place, a bottom panel 108, spaced from the true bottom wall 20 of the body member 14.

The manner in which the side mirror 94 and the bottom panel 108 may be applied to the bath cabinet 10 should now be apparent.

After installation of the mounting bracket 72 on the wall 12, the bottom panel 108 may be friction-fitted into the channel 82. The bath cabinet 10 may be lifted and fitted downwardly over the flange 76 of the mounting bracket 72, while the bottom panel 108 is guided into the channel 80 of the mounting bracket 72. Retaining brackets or clips, such as the retaining bracket 84 may be loosely applied as needed, to secure the top of bath cabinet 10. The cabinet may then be levelled. The side mirrors, for example 92, may then be loosely fitted to each side of the bath cabinet 10 with the channels 116 engaged with side edges of the bottom panel 108. When the installer is satisfied with the trial position of the side mirror 94, the conventional protective strips 118 (seen in FIG. 2) associated with one face of the tape 112 may be removed, and the side mirror applied to the side wall member 16.

The appearance of the face of the bath cabinet 10 may be enhanced if desired, by mirror strips 120, 122 pre-applied to faces of the upper and lower frame members 54, 56. Such strips, in conjunction with the mirror of the door 62 itself and the side mirrors 92 and 94, give to the bath cabinet 10 a pleasing overall "finished" aspect.

The present invention may be embodied in other specific forms without departing from its spirit or essential attributes. Accordingly, reference should be made to the appended claims rather than the foregoing specification as indicating the scope of the invention.

I claim:

1. In combination with a surface-mounted bath cabinet having respective side, top, bottom and rear walls, a mounting bracket adapted to be secured to the surface of a wall, said mounting bracket having means thereon engagable with the cabinet to support and position the cabinet, a first channel on said mounting bracket facing away from the wall, a second channel on said cabinet facing toward the wall when the cabinet is operatively disposed, a bottom trim panel having respective longitudinal edges thereof received within said first and second channels, and a pair of side trim members coupled to said cabinet to provide finished side panels for the side walls of the cabinet, said side trim members having brackets thereon adjacent to their lower edges, said brackets having third channels thereon extending below said side walls, lateral edges of said bottom trim panel being engagable with and receivable within said third channels when said side panels are operatively disposed, and means on said side panels for securing said side panels to the side walls of the cabinet.

2. In combination with a bath cabinet having a mirror door and adapted to be mounted on the surface of a wall, a mounting bracket adapted to be secured to the wall, said mounting bracket being engagable with the cabinet to support and position the cabinet with respect to the wall, a first channel on said mounting bracket facing away from the wall, a second channel on said cabinet facing toward the wall when the cabinet is operatively disposed, a bottom trim panel having respective longitudinal edges thereof engagable with and receivable within said first and second channels, and a pair of side mirrors adapted to be coupled to said cabinet to provide finished and mirrored side panels for the side walls of the cabinet, said side trim panels having angle brackets adjacent to their lower edges, said angle brackets having third channels, lateral edges of said bottom trim panel being engageable with and receivable within said third channels when said side are operatively disposed, and means on said side panels for securing said side panels to the side walls of the cabinet.

* * * * *